US010663196B2

(12) United States Patent
Zha

(10) Patent No.: US 10,663,196 B2
(45) Date of Patent: May 26, 2020

(54) COOLING SYSTEM

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 85 days.

(21) Appl. No.: 16/000,067

(22) Filed: Jun. 5, 2018

(65) Prior Publication Data

US 2019/0368784 A1 Dec. 5, 2019

(51) Int. Cl.

| | |
|---|---|
| ***F25B 9/00*** | (2006.01) |
| ***F25B 40/04*** | (2006.01) |
| ***F25B 1/10*** | (2006.01) |
| ***F25B 5/00*** | (2006.01) |
| ***F25B 19/00*** | (2006.01) |
| ***F25D 13/04*** | (2006.01) |

(52) U.S. Cl.

CPC ..... *F25B 9/006* (2013.01); *F25B 1/10* (2013.01); *F25B 5/00* (2013.01); *F25B 19/005* (2013.01); *F25B 40/04* (2013.01); *F25D 13/04* (2013.01); *F25B 2339/046* (2013.01); *F25B 2400/053* (2013.01); *F25B 2400/075* (2013.01)

(58) Field of Classification Search

CPC .... F25B 9/006; F25B 40/04; F25B 2400/053; F25B 2400/13; F25B 2400/24; F25B 1/10

See application file for complete search history.

(56) References Cited

U.S. PATENT DOCUMENTS

| | | | | |
|---|---|---|---|---|
| 4,554,799 | A | 11/1985 | Pallanch | |
| 5,235,820 | A | 8/1993 | Radermacher et al. | |
| 8,671,704 | B2 * | 3/2014 | Zimmermann | F25B 40/00 62/157 |
| 10,415,855 | B2 * | 9/2019 | Kawano | F25B 1/10 |
| 2006/0042282 | A1 | 3/2006 | Ludwig et al. | |
| 2010/0199707 | A1 | 8/2010 | Pearson | |

(Continued)

FOREIGN PATENT DOCUMENTS

| | | |
|---|---|---|
| EP | 3196568 A1 | 7/2017 |
| JP | H09196480 | 7/1997 |

(Continued)

OTHER PUBLICATIONS

Huff, H, et al., "Options for Two-Stage Transcritical Carbon Dioxide Cycle," XP-001176579, Sep. 17, 2019, pp. 158-164.

(Continued)

*Primary Examiner* — Nelson J Nieves

(74) *Attorney, Agent, or Firm* — Baker Botts L.L.P.

(57) ABSTRACT

An apparatus includes a flash tank, a load, a first compressor, a coil, a first pipe, and a second compressor. The flash tank stores a refrigerant. The load uses the refrigerant from the flash tank to cool a space proximate the load. The first compressor compresses the refrigerant from the load. The coil within the flash tank receives the refrigerant from the first compressor such that the received refrigerant is within the coil. The refrigerant stored within the flash tank cools the refrigerant within the coil. The first pipe is within the flash tank. The first pipe directs the refrigerant from within the coil out of the flash tank. The second compressor compresses the refrigerant directed out of the flash tank.

17 Claims, 3 Drawing Sheets

(56) References Cited

U.S. PATENT DOCUMENTS

| | | | | |
|---|---|---|---|---|
| 2010/0326100 | A1* | 12/2010 | Taras | F25B 1/10 62/115 |
| 2011/0036110 | A1* | 2/2011 | Fujimoto | F24D 3/18 62/149 |
| 2013/0145791 | A1* | 6/2013 | Christensen | F25B 1/10 62/498 |
| 2013/0213084 | A1* | 8/2013 | Takizawa | F04C 23/001 62/510 |
| 2014/0090407 | A1* | 4/2014 | Piesker | F25B 43/006 62/119 |
| 2015/0345835 | A1* | 12/2015 | Martin | F25B 7/00 62/238.3 |
| 2017/0051949 | A1* | 2/2017 | Uselton | F25B 9/10 |
| 2017/0205120 | A1* | 7/2017 | Ali | F25B 5/02 |
| 2017/0227258 | A1* | 8/2017 | Kawano | F25B 1/10 |
| 2017/0284715 | A1* | 10/2017 | Mukherjee | F25B 5/02 |
| 2019/0161660 | A1* | 5/2019 | Yana Motta | C09K 5/044 |

FOREIGN PATENT DOCUMENTS

| | | | |
|---|---|---|---|
| WO | 2012176072 | A2 | 12/2012 |
| WO | 2012176072 | A3 | 12/2012 |

OTHER PUBLICATIONS

European Patent Office, Extended European Search Report, Application No. 19175595.8, dated Nov. 22, 2019, 7 pages.

* cited by examiner

COOLING SYSTEM

TECHNICAL FIELD

This disclosure relates generally to a cooling system, such as a refrigeration system.

BACKGROUND

Cooling systems are used to cool spaces, such as residential dwellings, commercial buildings, and/or refrigeration units. These systems cycle a refrigerant (also referred to as charge) that is used to cool the spaces.

SUMMARY OF THE DISCLOSURE

A typical commercial refrigeration system includes a medium temperature section (e.g., produce shelves) and a low temperature section (e.g., freezers). A low temperature compressor compresses the refrigerant from the low temperature section. A medium temperature compressor compresses a mixture of the refrigerant from the medium temperature section and the compressed refrigerant from the low temperature compressor. Thus, the temperature of the refrigerant from the low temperature section and the temperature of the refrigerant from the medium temperature section affect the temperature of the mixture received at the medium temperature compressor. Typically, the refrigerant from the medium temperature section cools the refrigerant from the low temperature section as they are mixed.

A problem occurs in existing systems when the medium temperature loads are shut off or removed from a system. For example, a grocery store may decide to downsize and remove produce shelves but keep freezers with frozen foods. As another example, a convenience store may install only freezers. In these systems, there may not be any (or there may be an insufficient amount of) refrigerant from a medium temperature section to cool the refrigerant form the low temperature section. Consequently, the refrigerant that is received by the medium temperature compressor may be too hot for the medium temperature compressor to handle appropriately. The performance and efficiency of the medium temperature compressor is thus damaged.

This disclosure contemplates an unconventional cooling system that directs refrigerant from the low temperature compressor into a coil within a flash tank. The liquid refrigerant in the flash tank cools the refrigerant within the coil. The cooled refrigerant is then directed out of the flash tank and to the medium temperature compressor. As a result, the refrigerant received by the medium temperature compressor is at a more suitable temperature and the performance of the medium temperature compressor is improved. Certain embodiments of the system will be described below.

According to an embodiment, an apparatus includes a flash tank, a load, a first compressor, a coil, a first pipe, and a second compressor. The flash tank stores a refrigerant. The load uses the refrigerant from the flash tank to cool a space proximate the load. The first compressor compresses the refrigerant from the load. The coil within the flash tank receives the refrigerant from the first compressor such that the received refrigerant is within the coil. The refrigerant stored within the flash tank cools the refrigerant within the coil. The first pipe is within the flash tank. The first pipe directs the refrigerant from within the coil out of the flash tank. The second compressor compresses the refrigerant directed out of the flash tank.

According to another embodiment, a method includes storing, by a flash tank, a refrigerant. The method also includes using, by a load, the refrigerant from the flash tank to cool a space proximate the load and compressing, by a first compressor, the refrigerant from the load. The method further includes receiving, by a coil within the flash tank, the refrigerant from the first compressor such that the received refrigerant is within the coil. The refrigerant stored within the flash tank cools the refrigerant within the coil. The method also includes directing, by a first pipe within the flash tank, the refrigerant from within the coil out of the flash tank and compressing, by a second compressor, the refrigerant directed out of the flash tank.

According to yet another embodiment, a system includes a high side heat exchanger, a flash tank, a load, a first compressor, a coil, a first pipe, and a second compressor. The high side heat exchanger removes heat from a refrigerant. The flash tank stores the refrigerant from the high side heat exchanger. The load uses the refrigerant from the flash tank to cool a space proximate the load. The first compressor compresses the refrigerant from the load. The coil within the flash tank receives the refrigerant from the first compressor such that the received refrigerant is within the coil. The refrigerant stored within the flash tank cools the refrigerant within the coil. The first pipe is within the flash tank. The first pipe directs the refrigerant from within the coil out of the flash tank. The second compressor compresses the refrigerant directed out of the flash tank and to direct the refrigerant to the high side heat exchanger.

Certain embodiments provide one or more technical advantages. For example, an embodiment reduces the temperature of a refrigerant at the suction of a medium temperature compressor when a medium temperature load is not being or is not present. As another example, an embodiment improves the performance of a compressor by cooling a refrigerant mixture at the suction of the compressor. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
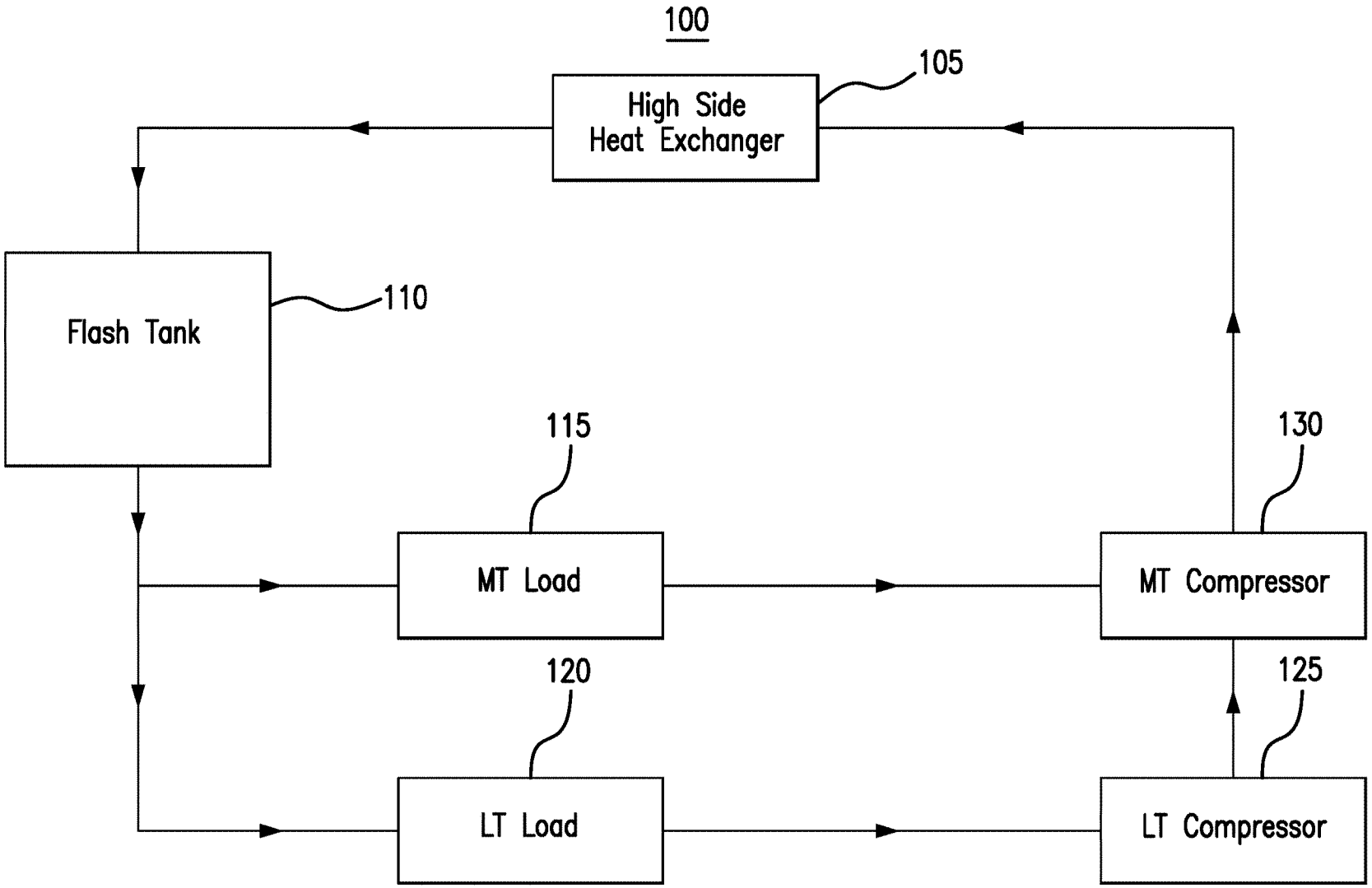
FIG. 1 illustrates an example cooling system.
Figure 2:
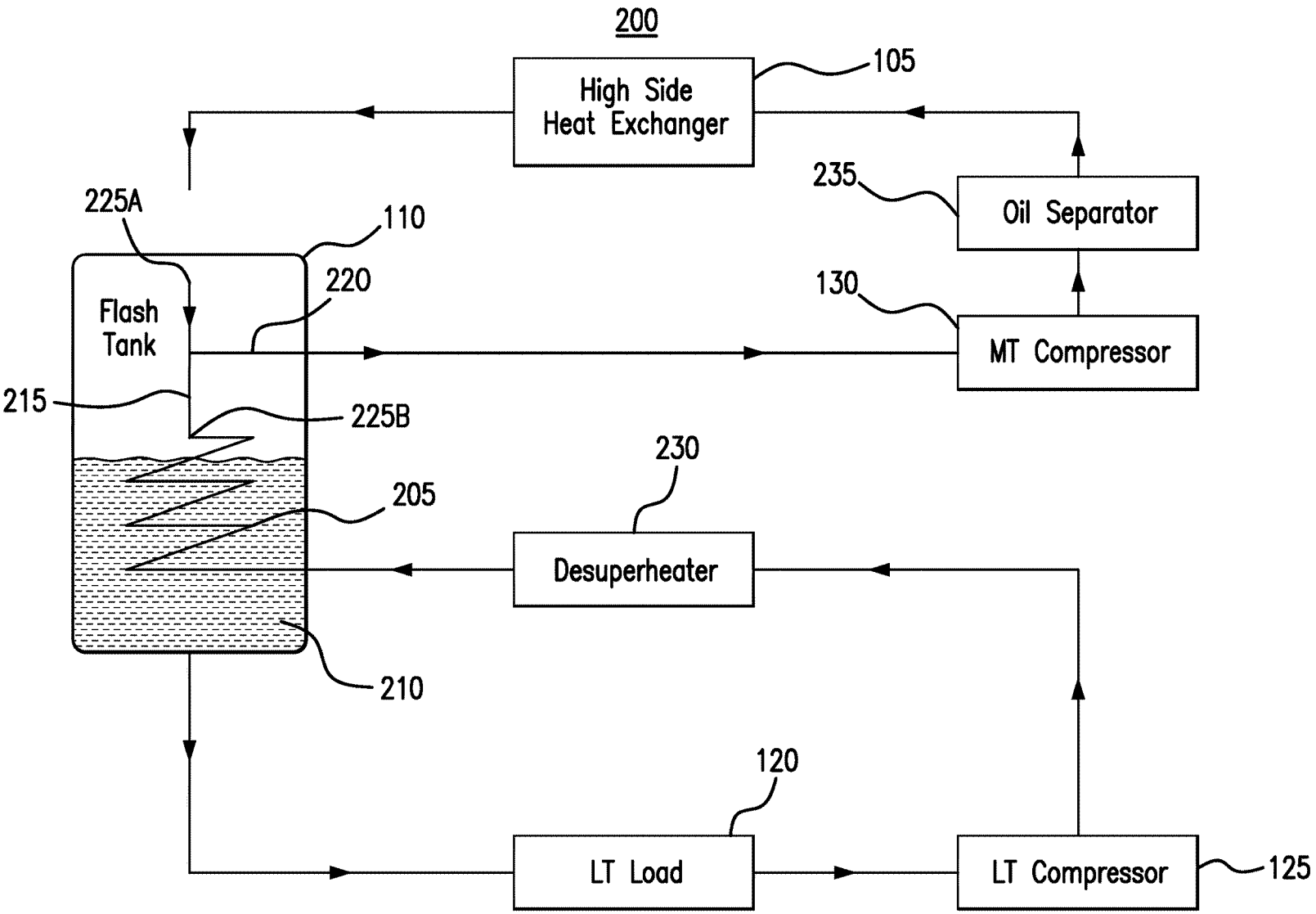
FIG. 2 illustrates an example cooling system.
Figure 3:
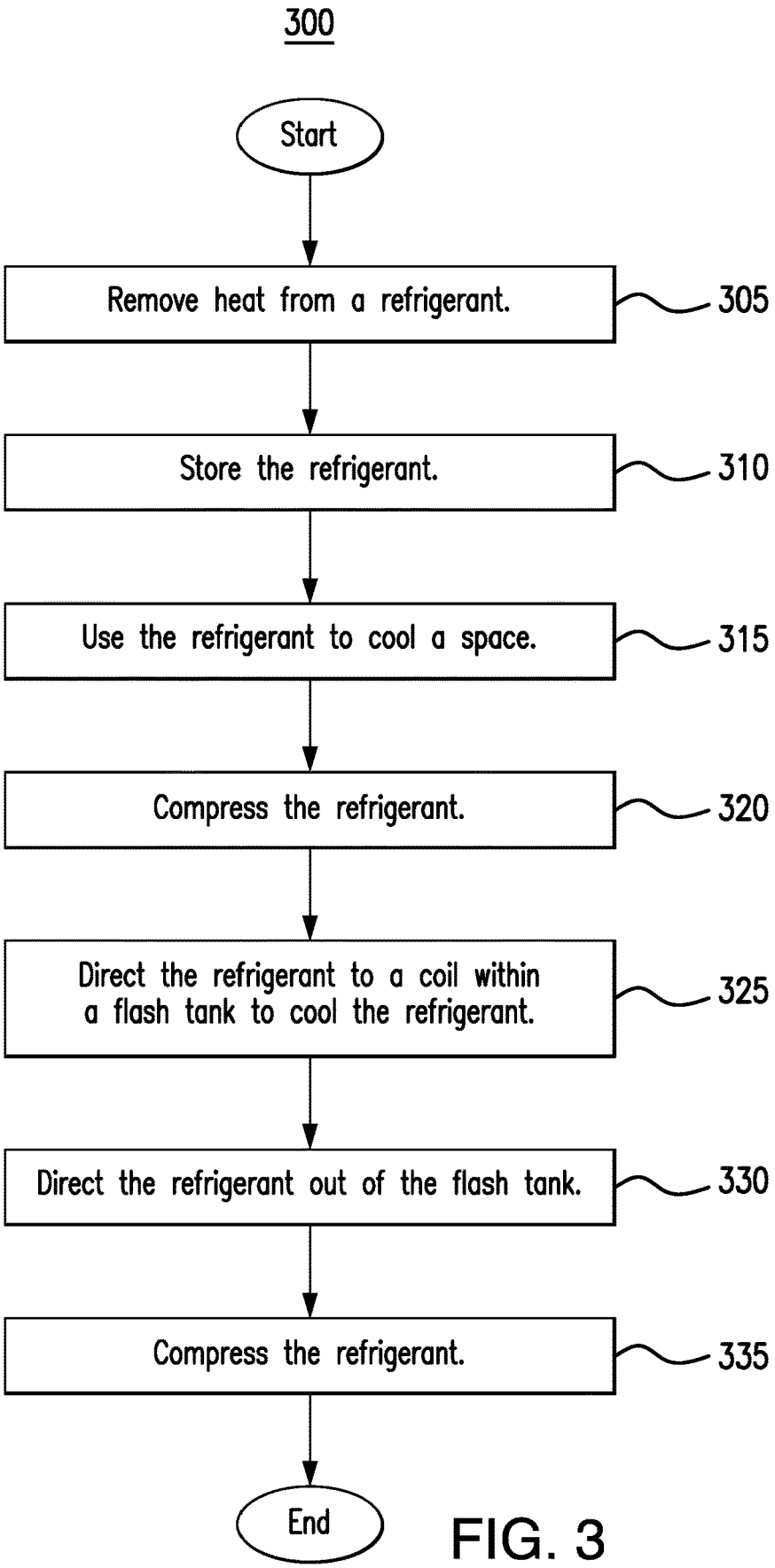
FIG. 3 is a flowchart illustrating a method for operating the cooling system of FIG. 2.

Embodiments of the present disclosure and its advantages are best understood by referring to FIGS. 1 through 3 of the drawings, like numerals being used for like and corresponding parts of the various drawings.

Cooling systems are used to cool spaces, such as residential dwellings, commercial buildings, and/or refrigeration units. These systems cycle a refrigerant (also referred to as charge) that is used to cool the spaces. A typical commercial refrigeration system includes a medium temperature section (e.g., produce shelves) and a low temperature section (e.g., freezers). A low temperature compressor compresses the refrigerant from the low temperature section. A medium temperature compressor compresses a mixture of the refrigerant from the medium temperature section and the compressed refrigerant from the low temperature compressor. Thus, the temperature of the refrigerant from the low temperature section and the temperature of the refrigerant from the medium temperature section affect the temperature of the mixture received at the medium temperature compressor. Typically, the refrigerant from the medium temperature section cools the refrigerant from the low temperature section as they are mixed.

A problem occurs in existing systems when the medium temperature loads are shut off or removed from a system. For example, a grocery store may decide to downsize and remove produce shelves but keep freezers with frozen foods. As another example, a convenience store may install only freezers. In these systems, there may not be any (or there may be an insufficient amount of) refrigerant from a medium temperature section to cool the refrigerant form the low temperature section. Consequently, the refrigerant that is received by the medium temperature compressor may be too hot for the medium temperature compressor to handle appropriately. The performance and efficiency of the medium temperature compressor is thus damaged.

For example, FIG. 1 illustrates an example cooling system 100. As shown in FIG. 1, system 100 includes a high side heat exchanger 105, a flash tank 110, a medium temperature load 115, a low temperature load 120, a low temperature compressor 125, and a medium temperature compressor 130. Generally, these components cycle a refrigerant to cool spaces proximate medium temperature load 115 and low temperature load 120.

High side heat exchanger 105 removes heat from a refrigerant (e.g., carbon dioxide). When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools gaseous and/or supercritical refrigerant and the refrigerant remains a gas and/or a supercritical fluid. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Flash tank 110 stores refrigerant received from high side heat exchanger 105. This disclosure contemplates flash tank 110 storing refrigerant in any state such as, for example, a liquid state and/or a gaseous state. Refrigerant leaving flash tank 110 is fed to low temperature load 120 and medium temperature load 115. In some embodiments, a flash gas and/or a gaseous refrigerant is released from flash tank 110. By releasing flash gas, the pressure within flash tank 110 may be reduced.

System 100 includes a low temperature portion and a medium temperature portion. The low temperature portion typically operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. As seen in FIG. 1, system 100 includes a medium temperature load 115 and a low temperature load 120. The medium temperature portion includes medium temperature load 115, and the low temperature portion includes low temperature load 120. Each of these loads is used to cool a particular space. For example, medium temperature load 115 may be a produce shelf in a grocery store and low temperature load 120 may be a freezer case. Generally, low temperature load 120 keeps a space cooled to freezing temperatures (e.g., below 32 degrees Fahrenheit) and medium temperature load 115 keeps a space cooled above freezing temperatures (e.g., above 32 degrees Fahrenheit).

Refrigerant flows from flash tank 110 to both the low temperature and medium temperature portions of the refrigeration system. For example, the refrigerant may flow to low temperature load 120 and medium temperature load 115. When the refrigerant reaches low temperature load 120 or medium temperature load 115, the refrigerant removes heat from the air around low temperature load 120 or medium temperature load 115. As a result, the air is cooled. The cooled air may then be circulated such as, for example, by a fan to cool a space such as, for example, a freezer and/or a refrigerated shelf. As refrigerant passes through low temperature load 120 and medium temperature load 115, the refrigerant may change from a liquid state to a gaseous state as it absorbs heat.

Refrigerant flows from low temperature load 120 and medium temperature load 115 to compressors 125 and 130. This disclosure contemplates system 100 including any number of low temperature compressors 125 and medium temperature compressors 130. The low temperature compressor 125 and medium temperature compressor 130 may be configured to increase the pressure of the refrigerant. As a result, the heat in the refrigerant may become concentrated and the refrigerant may become a high-pressure gas. Low temperature compressor 125 compresses refrigerant from low temperature load 120 and sends the compressed refrigerant to medium temperature compressor 130. Medium temperature compressor 130 compresses refrigerant from low temperature compressor 125 and/or medium temperature load 115. The refrigerant from low temperature compressor 125 mixes with and is cooled by the refrigerant from medium temperature load 115 before entering medium temperature compressor 130. Medium temperature compressor 130 may then send the compressed refrigerant to high side heat exchanger 105.

A problem occurs in existing systems when medium temperature load 115 is shut off or removed from system 100. For example, a grocery store may decide to downsize and remove produce shelves but keep freezers with frozen foods. As another example, a convenience store may install only freezers. After medium temperature load 115 is shut off or removed, there may not be any (or there may not be a sufficient amount of) refrigerant from a medium temperature section to cool the refrigerant form low temperature compressor 125. Consequently, the refrigerant that is received by medium temperature compressor 130 may be too hot for medium temperature compressor 130 to handle appropriately. The performance and efficiency of medium temperature compressor 130 is thus damaged.

This disclosure contemplates an unconventional cooling system that directs refrigerant from the low temperature compressor into a coil within a flash tank. The liquid refrigerant in the flash tank cools the refrigerant within the coil. The cooled refrigerant is then directed out of the flash tank and to the medium temperature compressor. As a result, the refrigerant received by the medium temperature compressor is at a more suitable temperature and the performance of the medium temperature compressor is improved. The cooling system will be described in more detail using FIGS. 2 through 3.

FIG. 2 illustrates an example cooling system 200. As shown in FIG. 2 system 200 includes a high side heat exchanger 105, a flash tank 110, a low temperature load 120, a low temperature compressor 125, a medium temperature compressor 130, a coil 205, a pipe 215, a pipe 220, a desuperheater 230, and an oil separator 234. Generally, system 200 improves the performance of medium temperature compressor 130 by directing refrigerant from low temperature compressor 125 into coil 205. A refrigerant 210 stored in a flash tank 110 then cools the refrigerant in coil 205. The cooled refrigerant is then directed out of flash tank 110 to medium temperature compressor 130. In this manner, medium temperature compressor 130 receives a refrigerant that it can appropriately handle. As a result, the performance of medium temperature compressor 130 is improved in certain embodiments.

High side heat exchanger 105, flash tank 110, low temperature load 120, low temperature compressor 125, and medium temperature compressor 130 operate similarly as they did in system 100. For example, high side heat exchanger 105 removes heat from a refrigerant. Flash tank 110 stores the refrigerant. Low temperature load 120 uses the refrigerant to cool a space proximate low temperature load 120. Low temperature compressor 125 compresses the refrigerant from low temperature load 120. Medium temperature compressor 130 compresses the refrigerant from low temperature compressor 125. One significant difference between system 200 and system 100 is that system 200 does not include a medium temperature load. As a result, there is no refrigerant from a medium temperature load to mix with the refrigerant from low temperature compressor 125 before that refrigerant is directed to medium temperature compressor 130. Because there is no refrigerant from a medium temperature load to cool the refrigerant from low temperature compressor 125, system 200 employs a different mechanism to cool the refrigerant from low temperature compressor 125 before it reaches medium temperature compressor 130.

Coil 205 is positioned within flash tank 110. In certain embodiments, portions of coil 205 are submerged within a liquid refrigerant 210 stored within flash tank 110. Refrigerant from low temperature compressor 125 is directed into coil 205 such that the refrigerant flows within coil 205. As the refrigerant flows through coil 205, the liquid refrigerant 210 stored within flash tank 110 absorbs heat from the refrigerant flowing within coil 205. As a result, the refrigerant within coil 205 is cooled. As seen in FIG. 2, coil 205 is positioned near a bottom surface of flash tank 110. Refrigerant from low temperature compressor 125 enters coil 205 near the bottom surface of flash tank 110. Because the refrigerant is a gas, the refrigerant flows through coil 205 upwards towards a top surface of flash tank 110. As the refrigerant flows towards the top surface, liquid refrigerant 210 absorbs heat from the refrigerant flowing within coil 205. Coil 205 may be made using any thermally-conductive material, such as, for example, a metal. Although coil 205 is referred to as a coil, this disclosure contemplates coil 205 being any structure that contains refrigerant from low temperature compressor 125 and allows that refrigerant to flow through the structure. For example, coil 205 may be a straight pipe or a pipe configured in any shape.

System 200 includes a pipe 215 coupled to coil 205. As seen in FIG. 2, pipe 215 couples to a top portion of coil 205. Pipe 215 is positioned above coil 205 such that pipe 215 is closer to a top surface of flash tank 110 than coil 205. Pipe 215 includes a top end 225A and a bottom end 225B. Bottom end 225B couples to coil 205. Refrigerant flowing upwards through coil 205 enters pipe 215 through bottom end 225B. Pipe 215 is positioned above liquid refrigerant 210 in certain embodiments such that pipe 215 is not in contact with liquid refrigerant 210.

Flash gas within flash tank 110 enters pipe 215 through top end 225A. For example, as liquid refrigerant 210 absorbs heat from the refrigerant flowing within coil 205, portions of liquid refrigerant 210 may convert to a flash gas. The flash gas rises in flash tank 110 and enters pipe 215 through top end 225A.

Pipe 220 is positioned within flash tank 110. As seen in FIG. 2, pipe 220 couples to pipe 215. In some embodiments, pipe 220 is positioned within flash tank 110 such that pipe 220 is not in contact with liquid portions of refrigerant 210 stored in flash tank 110. Refrigerant from coil 205 that enters pipe 215 through bottom end 225B and flash gas in flash tank 110 that enters pipe 215 through top end 225A flow through pipe 215 into pipe 220. Pipe 220 then directs the refrigerant and the flash gas through pipe 220 and out of flash tank 110 to medium temperature compressor 130. Medium temperature compressor 130 then compresses the refrigerant and the flash gas. In certain embodiments, because the suction of medium temperature compressor 130 is at a lower pressure than the internal pressure of flash tank 110, medium temperature compressor 130 effectively sucks the refrigerant within coil 205 and the flash gas in flash tank 110 through pipe 215 and pipe 220 to medium temperature compressor 130.

As discussed previously, because the refrigerant from low temperature compressor 125 is cooled within coil 205, medium temperature compressor 130 can appropriately handle the refrigerant. As a result, the performance of medium temperature compressor 130 improves in certain embodiments. In this manner, system 200 can operate efficiently even if a medium temperature load is shut off or removed from the system.

System 200 may include a desuperheater 230. As seen in FIG. 2, desuperheater 230 receives refrigerant from low temperature compressor 125 and directs that refrigerant to coil 205. Desuperheater 230 removes heat from the refrigerant flowing through Desuperheater 230. In this manner, the refrigerant from low temperature compressor 125 is cooled by desuperheater 230 before it is further cooled within coil 205. Certain embodiments do not include desuperheater 230. In those embodiments, refrigerant from low temperature compressor 125 flows directly to coil 205.

System 200 includes, an oil separator 235. Refrigerant from medium temperature compressor 130 flows through oil separator 235 before reaching high side heat exchanger 105. Oil separator 235 separates oil that may have mixed with the refrigerant. The oil may have mixed with the refrigerant in low temperature compressor 125 and/or medium temperature compressor 130. By separating the oil from the refrigerant, oil separator 235 protects other components of system 200 from being clogged and/or damaged by the oil. Oil separator 235 may collect the separated oil. The oil may then be removed from oil separator 235 and added back to low temperature compressor 125 and/or medium temperature compressor 130. Certain embodiments do not include oil separator 235. In these embodiments, refrigerant from medium temperature compressor 130 flows directly to high side heat exchanger 105.

FIG. 3 is a flow chart illustrating a method 300 for operating the cooling system 200 of FIG. 2. In particular embodiments, various components of system 200 perform the steps of method 300. By performing method 300, system 200 improves the performance of a compressor within system 200 in particular embodiments.

A high side heat exchanger begins by removing heat from a refrigerant in step 305. In step 310, a flash tank stores the refrigerant. A load then uses the refrigerant to cool a space in step 315. In step 320, a low temperature compressor compresses the refrigerant.

After the low temperature compressor compresses the refrigerant, the low temperature compressor directs the refrigerant to a coil within a flash tank to cool the refrigerant in step 325. The refrigerant within the coil may be cooled by a liquid refrigerant stored within the flash tank as the refrigerant within the coil flows through the coil. In step 330, the refrigerant is directed out of the flash tank. There may be piping configured within the flash tank to direct the refrigerant out of the flash tank and to a medium temperature compressor. In step 335, a medium temperature compressor compresses the refrigerant. After the refrigerant is compressed, the medium temperature compressor may direct the refrigerant to the high side heat exchanger.

Modifications, additions, or omissions may be made to method 300 depicted in FIG. 3. Method 300 may include more, fewer, or other steps. For example, steps may be performed in parallel or in any suitable order. While discussed as system 200 (or components thereof) performing the steps, any suitable component of system 200 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a flash tank configured to store a refrigerant;

a load configured to use the refrigerant from the flash tank to cool a space proximate the load;

a first compressor configured to compress the refrigerant from the load;

a coil within the flash tank configured to receive the refrigerant from the first compressor such that the received refrigerant is within the coil, the refrigerant stored within the flash tank cools the refrigerant within the coil;

a first pipe within the flash tank, the first pipe configured to direct the refrigerant from within the coil out of the flash tank;

a second pipe within the flash tank, the second pipe comprising a first end and a second end, the second pipe configured such that a flash gas enters the second pipe through the first end, the second pipe positioned above the coil, the second end of the second pipe coupled to the coil such that the refrigerant within the coil enters the second pipe through the second end, the first pipe coupled to the second pipe, the first pipe further configured to direct the flash gas from within the second pipe out of the flash tank; and a second compressor configured to compress the refrigerant and the flash gas directed out of the flash tank.

2. The apparatus of claim 1, further comprising a desuperheater configured to remove heat from the refrigerant from the first compressor and to direct the refrigerant to the coil.

3. The apparatus of claim 1, further comprising an oil separator configured to separate an oil from the refrigerant from the second compressor.

4. The apparatus of claim 1, wherein a portion of the coil is submerged within a liquid portion of the refrigerant stored in the flash tank.

5. The apparatus of claim 1, wherein the first pipe and the second pipe are not in contact with a liquid portion of the refrigerant stored in the flash tank.

6. The apparatus of claim 1, wherein the refrigerant is carbon dioxide.

7. A method comprising:

storing, by a flash tank, a refrigerant;

using, by a load, the refrigerant from the flash tank to cool a space proximate the load;

compressing, by a first compressor, the refrigerant from the load;

receiving, by a coil within the flash tank, the refrigerant from the first compressor such that the received refrigerant is within the coil, the refrigerant stored within the flash tank cools the refrigerant within the coil;

directing, by a first pipe within the flash tank, the refrigerant from within the coil out of the flash tank;

receiving, by a second pipe within the flash tank, the refrigerant within the coil, the second pipe comprising a first end and a second end, the second pipe configured such that a flash gas enters the second pipe through the first end, the second pipe positioned above the coil, the second end of the second pipe coupled to the coil such that the refrigerant within the coil enters the second pipe through the second end, the first pipe coupled to the second pipe;

directing, by the first pipe, the flash gas from within the second pipe out of the flash tank; and compressing, by a second compressor, the refrigerant and the flash gas directed out of the flash tank.

8. The method of claim 7, further comprising removing, by a desuperheater, heat from the refrigerant from the first compressor and to direct the refrigerant to the coil.

9. The method of claim 7, further comprising separating, by an oil separator, an oil from the refrigerant from the second compressor.

10. The method of claim 7, wherein a portion of the coil is submerged within a liquid portion of the refrigerant stored in the flash tank.

11. The method of claim 7, wherein the first pipe and the second pipe are not in contact with a liquid portion of the refrigerant stored in the flash tank.

12. The method of claim 7, wherein the refrigerant is carbon dioxide.

13. A system comprising:

a high side heat exchanger configured to remove heat from a refrigerant;

a flash tank configured to store the refrigerant;

a load configured to use the refrigerant from the flash tank to cool a space proximate the load;

a first compressor configured to compress the refrigerant from the load;

a coil within the flash tank configured to receive the refrigerant from the first compressor such that the received refrigerant is within the coil, the refrigerant stored within the flash tank cools the refrigerant within the coil;

a first pipe within the flash tank, the first pipe configured to direct the refrigerant from within the coil out of the flash tank;

a second pipe within the flash tank, the second pipe comprising a first end and a second end, the second pipe configured such that a flash gas enters the second pipe through the first end, the second pipe positioned above the coil, the second end of the second pipe coupled to the coil such that the refrigerant within the coil enters the second pipe through the second end, the first pipe coupled to the second pipe, the first pipe further configured to direct the flash gas from within the second pipe out of the flash tank; and a second compressor configured to compress the refrigerant and the flash gas directed out of the flash tank and to direct the refrigerant to the high side heat exchanger.

14. The system of claim 13, further comprising a desuperheater configured to remove heat from the refrigerant from the first compressor and to direct the refrigerant to the coil.

15. The system of claim 13, further comprising an oil separator configured to separate an oil from the refrigerant from the second compressor.

16. The system of claim 13, wherein a portion of the coil is submerged within a liquid portion of the refrigerant stored in the flash tank.

17. The system of claim 13, wherein the first pipe and the second pipe are not in contact with a liquid portion of the refrigerant stored in the flash tank.

* * * * *